United States Patent [19]

Montgomery et al.

[11] Patent Number: 4,987,626

[45] Date of Patent: Jan. 29, 1991

[54] LOCKING PLIERS WITH SCREWDRIVER HANDLES

[76] Inventors: Robert D. Montgomery, 1685 West 12th, Reno, Nev. 89503; Harold L. Hull, 401 Canyon Way SP.43, Sparks, Nev. 89434

[21] Appl. No.: 484,817

[22] Filed: Feb. 26, 1990

[51] Int. Cl.[5] ..... B25B 7/22

[52] U.S. Cl. ..... 7/127; 81/318; 81/416

[58] Field of Search ..... 7/127; 81/318, 319, 81/324, 325, 393, 394, 416

[56] References Cited

U.S. PATENT DOCUMENTS

| | | | |
|---|---|---|---|
| 1,251,228 | 12/1917 | Hartzman | 81/318 |
| 1,678,313 | 7/1928 | Atkinson | 81/318 X |
| 2,557,296 | 6/1951 | Kress | 81/416 X |
| 4,232,573 | 11/1980 | Dace, Jr. | 81/405 |
| 4,296,655 | 10/1981 | Tesoro | 81/405 |
| 4,603,607 | 8/1986 | Schaffner Jr. | 81/414 |
| 4,699,340 | 1/1988 | Igarashi | 81/416 |
| 4,719,827 | 1/1988 | Igarashi | 81/417 |
| 4,726,265 | 2/1988 | Reich | 81/411 |
| 4,726,266 | 2/1988 | Undin | 81/416 |
| 4,920,593 | 5/1990 | Finn | 7/127 |

*Primary Examiner*—James G. Smith

[57] ABSTRACT

A locking slip-joint pliers with a phillips screwdriver on one handle and a slot screwdriver on the other, with the pliers having four positions, the first and second positions being a conventional slip-joint pliers including jaws and a cutter while the third position locks the plier members at a 90 degree angle to each other thus providing a means to put pressure on the screwdriver tips, while the fourth position is a wide open position which partially locks the plier members in a substantially straight line, thus making an unusually long screwdriver.

10 Claims, 2 Drawing Sheets

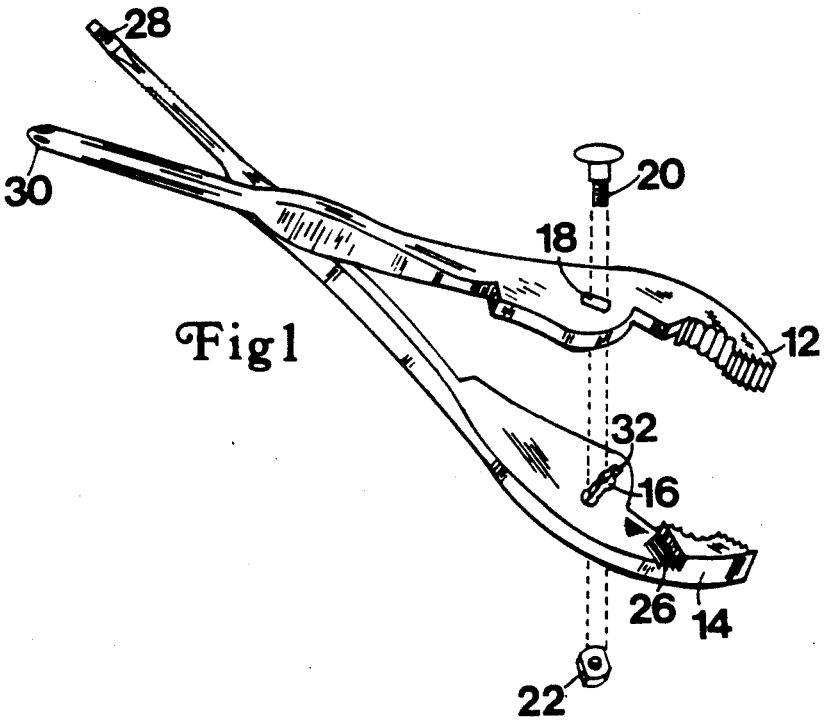
Fig 1
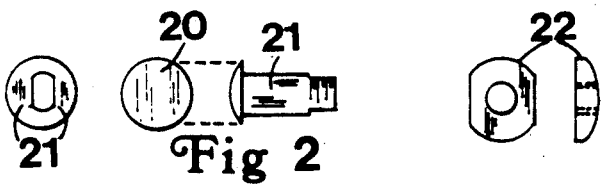
Fig 2
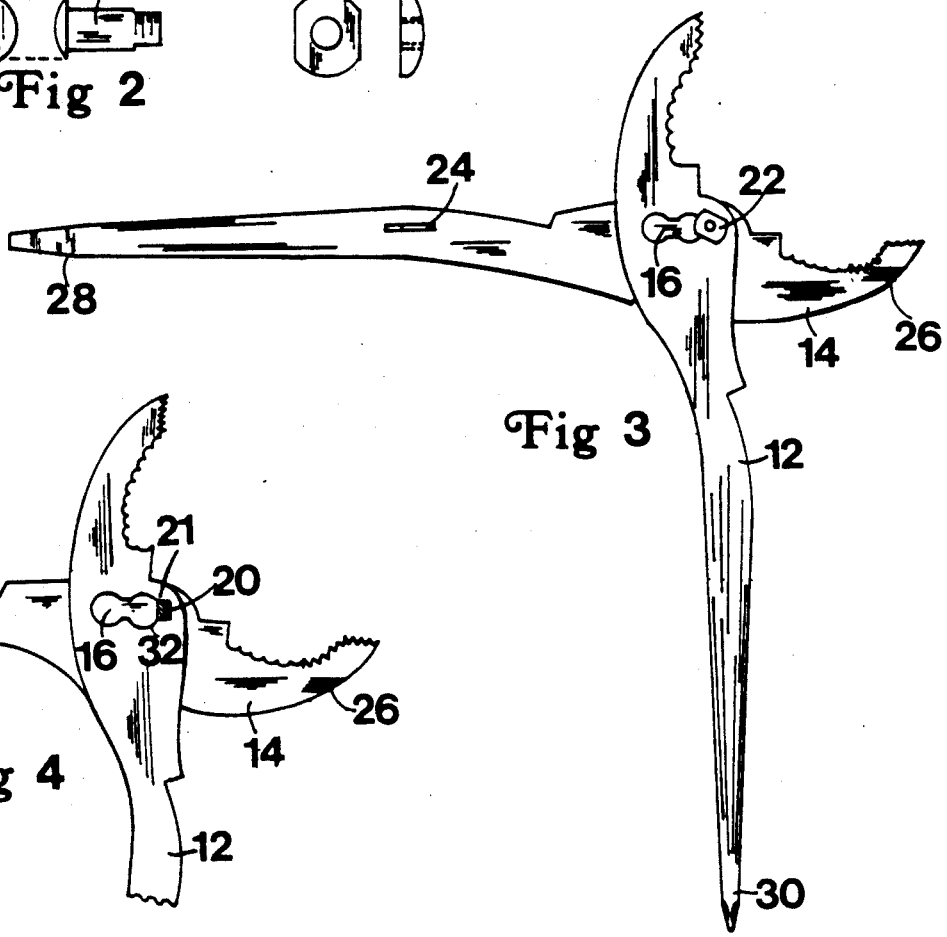
Fig 3
Fig 4

24

28
26
14
32
16

14
24
28
28
12
b
24
b
20
12
14
24
12
30

30
18

30

LOCKING PLIERS WITH SCREWDRIVER HANDLES

FIELD OF THE INVENTION

This invention relates to combination tools involving pliers and other tools and more particularly to pliers which use the handle portion as screwdrivers.

BACKGROUND OF THE INVENTION

In the past many combination tools have been taught which involve using the gripping action of pliers to not only grip but to cut, strip, lock onto, or other wise engage an object while at the same time using one or all of the distal ends of the pliers for use as another tool such as a wrench or screwdriver.

Although combination tools have been known for many years and have the advantages of convenience and lighter weight over separate tools to do the same jobs, they have generally achieved these advantages at the cost of efficiency for one or more of the specific tasks for which they are adapted. That is, in attempting to be jacks of all trades, they are rarely able to master even one. For example, the tools shown in U.S. Pat. Nos. 1,321,777 and 1,739,658 feature a screwdriver blade at the end of one of the handles of a pliers as also does design Pat. Nos. 281,216 and 255,529. Now as anyone who has used such a tool as a screwdriver will attest, this arrangement is far from satisfactory. The main drawback is the requirement that the user grip the sharp jaws of the pliers when applying pressure down on the screw to be driven.

Also, the prior art when using the handle of the pliers as a screwdriver have designed the handle with generally a curved handle which does not allow the screwdriver to engage the screw in a perpendicular manner but the pliers must be held at an angle and when used as a screwdriver the pliers end must swing through an arc in order to keep the screwdriver squarely in the fastener.

Pat. No. 3,946,453 approaches this problem by placing the screwdriver on one of the jaws of the pliers but now the depth of the handle is sacrificed and only surface screws can be addressed.

Also, the present inventors have on file an application No. 07/439,245 which addresses this problem, however, no means is provided in this application to lock the pliers in substantially a 90 degree angle to each other, or to allow the pliers to open to a substantially 180 degrees and provide retaining means to hold the pliers in this position.

Also the present inventors have on file an application No. 07/468,135 which teaches the partial locking of the plier members at substantially 90 degrees to each other by means of a ball-bearing and spring which is not a positive lock.

SUMMARY OF THE INVENTION

In overcoming these disadvantages of the prior art and in achieving other advantages, a combination tool made in accordance with the present invention includes a first and second plier member, each having a jaw section and handle section. The members are pivotably attached together to allow the jaws to move together in the conventional manner. However, the handle sections are so designed as to be perpendicular to the head of the fastener when used as a screwdriver and the member not engaging the fastener is turned substantially perpendicular to the first plier member and the plier members are locked so that when one of the screwdriver points associated with the plier member is used, the second plier member may be used by the user to more easily apply downward pressure and torque to the screwdriver point and fastener.

It is therefore, a primary object of the present invention to provide a combination tool which can serve as a conventional pliers without sacrificing any convenience and yet be used as a leveraged screwdriver with out sacrificing the advantages of a conventional leveraged screwdriver and by using both handles as screwdrivers, two different types of screwdrivers are provided.

It is another object to provide a combination tool which the handles are parallel to each other and perpendicular to the head of the work piece.

It is yet another object to provide means other than by grasping the jaw section to apply pressure to the screwdriver tips.

Still another object is to provide means to firmly lock the plier members at a 90 degree angle to each other.

Yet another object is to provide a design which will allow the plier members to open until both plier members are substantially in linear alignment with each other.

A further object is to provide retaining means between the two plier members when the plier members are opened to substantially their linear position.

Other advantages and objects will become obvious when taken in consideration with the following drawings and specifications.

BRIEF DESCRIPTION OF THE DRAWINGS

FIG. 1 is a perspective view of the present invention.

FIG. 2 is a bolt and nut.

FIG. 3 is a side view showing the pliers in a locked third position.

FIG. 4 is a partial side view showing the nut of FIG. 2-A removed and the rectangular sides of the bolt engaging the rectangular hole of plier member 12.

DETAILED DESCRIPTION OF THE DRAWINGS

Figures 5, 6, 7, 8, 9, 10, 11:
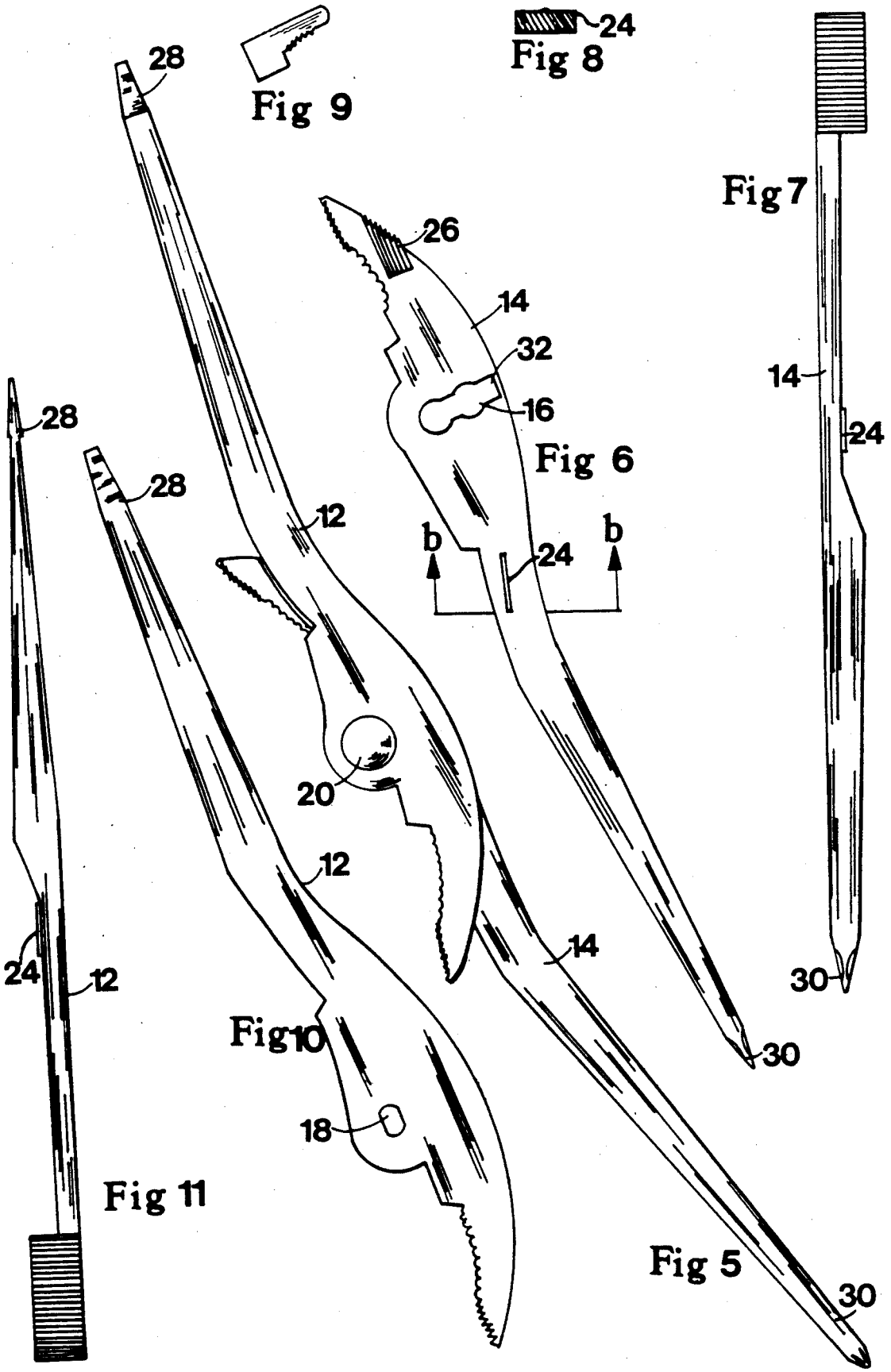
FIG. 5 is a side view showing the pliers in an open fourth position and partially locked.
FIG. 6 is an inside, side view of one of the plier members.
FIG. 7 is an edge view of FIG. 4.
FIG. 8 is a section taken at b—b of FIG. 4.
FIG. 9 is an end view of FIG. 4.
FIG. 10 is an inside, side view of a second plier member.
FIG. 11 is a side view of FIG. 8.

Referring now to the drawings in detail wherein like numerals designate like parts, 12 is a plier member with 14 being a second plier member, both plier members being pivoted together at holes 16 and 18 respectively, by rectangular bolt 20 and nut 22 while 24 is a raised boss cooperating with serrations 26 to partially lock the two plier members in an open position as shown in FIG. 5. 28 is a straight slot screwdriver while 30 is a phillips screwdriver with 32 being a rectangular portion of hole 16 to firmly engage the rectangular portion of bolt 20 to lock the plier members substantially at a 90 degree as shown in FIG. 2.

The plier members have 4 positions, that is a closed first and second positions in which the device acts as a regular pair of pliers, a third position where the plier members are at 90 degree angle to each other and a fourth position in which the plier members are substantially in a straight line with each other.

Now it will be seen that when the pliers are in their first position, that nothing has been sacrificed as the pliers perform as a regular set of pliers with jaws and wire cutter as usual, however, when the pliers are in their third, locked position, we have an unusual screwdriver arrangement and by using the cross member as a handle, pressure may be put on the work piece. Also, when the pliers are extended to their fourth position and partially locked they may also be used as an unusually long screwdriver.

It will also be noted that we have provided a slot screwdriver as well as a phillips screwdriver and that this is accomplished by a simple construction which lends itself to drop forging or casting with no complicated parts, and is simply assembled in production by one bolt and nut.

Although the invention has been herein shown and described in what is conceived to be the most practical and preferred embodiment, it is recognized that departures may be made therefrom withing the scope of the invention, which is not to be limited to the details disclosed herein but it is to be accorded the full scope of the claims so as to embrace any and all equivalent devices and apparatus.

Having described our invention, what we claim as new and desire to secure by letters patent is:

1. Locking slip-joint pliers comprising; a first and second plier member having a jaw section and a handle section, said plier members having means to be attached together to allow said jaw sections to be pivotally displaced toward and away from each other by moving said handle sections to and away from each other, said handle section of said first and said second plier member having at their distal ends a screwdriver, said plier members having a first, second, third and fourth positions, said plier members being substantially parallel to each other when said plier members are in said first and second positions, said plier member being at substantially a right angle to each other when in said third position, said plier member being substantially in a straight line with each other when in said forth position, means to lock said plier members in said third position and means to partially lock said plier members in said fourth position.

2. The device of claim 1 in which said jaw sections have cutting edges, said cutting edges being aligned so that they coact to cut an object placed between them when said jaw sections are pivotable displaced toward and away from each other.

3. The device of claim 1 in which said screwdriver at the distal ends of said plier members are a phillips and a straight slot screwdriver, respectively.

4. The device of claim 1 in which said means to pivotally attach them together is a bolt having a substantially rectangular shank cooperating with a substantially rectangular bolt hole of said first plier member and a first and second changeover hole of said second plier member, said shank comprising first and second convex opposite end faces of a corresponding curvature to said first and second changeover hole sections and said shank comprising first and second opposite side faces extending between said end faces respectively, said shank having a width between said side faces substantially equal to the length of said rectangular intermediate hole, said shank having a length between said end faces greater than that of said intermediate rectangular hole, and said shank extending into said first changeover hole.

5. The device of claim 4 in which said means to lock said plier members in said third position is a substantially rectangular hole in said second plier member cooperating with said shank of said rectangular bolt to lock said first and second plier members in substantially a 90 degree angle to each other.

6. The device of claim 1 in which said means to partially lock said plier members is a raised boss on said first and said second plier members cooperating with serrations on said first and second plier members, respectively, said bosses and said serrations being aligned so that they coact to tension said plier members away from each other when said plier members are in their said fourth position.

7. Locking slip-joint pliers comprising; a first plier member having a handle portion and a jaw portion, a second plier member having a handle portion and a jaw portion, said second plier member pivotally and slidably mounted relative to said first plier member at a section intermediate said handle and said jaw portions for being pivotable relative to said first plier member at a first position and for being slidable relative to said first plier member between said first position and a second position at which said second plier member is pivotable relative to said first plier member, said second plier member being slidable relative to said first plier member to a lockable, un-pivotable third position, said second plier member having a bolt hole extending therethrough at said intermediate section comprising a first circular changeover hole, an intermediate rectangular hole open to and communicating with said first circular changeover hole, a second circular changeover hole open to and communicating with said intermediate rectangular hole opposite from said first changeover hole, a third rectangular hole open to and communicating with said second circular changeover hole, a bolt, a nut for securing said bolt to said first and second plier members, said handle portion of said first plier member having at its distal end a phillips screwdriver, said handle of said second plier member having at its distal end a slot screwdriver, said plier members being substantially parallel to each other when said plier members are in said first and second positions, said plier members being substantially at a right angle to each other when in said third position, said plier members being substantially in a straight line with each other when in a fourth position, means to lock said plier members in said third position and means to partially lock said plier members in said fourth position.

8. The device of claim 7 in which said jaw sections have cutting edges, said cutting edges being aligned so that they coact to cut an object placed between them when said jaw sections are pivotable displaced toward and away from each other.

9. The device of claim 7 in which said means to lock said plier members in said third position is a substantially rectangular hole in said second plier member cooperating with said shank of said rectangular bolt to lock said first and second plier members in substantially a 90 degree angle to each other.

10. The device of claim 7 in which said means to partially lock said plier members in a fourth position is a raised boss on said first and said second plier members cooperating with serrations on said first and second plier members, respectively, said bosses and said serrations being aligned so that they coact to tension said plier members away from each other when said plier members are in their said fourth position.

* * * * *